US005386692A

United States Patent [19]

Laforce

[11] Patent Number: 5,386,692

[45] Date of Patent: Feb. 7, 1995

[54] CRYOGENIC RECTIFICATION SYSTEM WITH HYBRID PRODUCT BOILER

[75] Inventor: Craig S. Laforce, Amherst, N.Y.

[73] Assignee: Praxair Technology, Inc., Danbury, Conn.

[21] Appl. No.: 193,584

[22] Filed: Feb. 8, 1994

[51] Int. Cl.[6] ..... F25J 3/02

[52] U.S. Cl. ..... 62/25; 62/38; 62/41

[58] Field of Search ..... 62/24, 25, 41, 38

[56] References Cited

U.S. PATENT DOCUMENTS

| | | | |
|---|---|---|---|
| 4,769,055 | 9/1988 | Erickson | 62/25 |
| 5,098,456 | 3/1992 | Dray et al. | 62/24 |
| 5,108,476 | 4/1992 | Dray et al. | 62/24 |
| 5,114,452 | 5/1992 | Dray | 62/24 |
| 5,148,680 | 9/1992 | Dray | 62/24 |
| 5,228,297 | 7/1993 | Olson, Jr. et al. | 62/25 |
| 5,245,832 | 9/1993 | Roberts | 62/24 |
| 5,263,327 | 11/1993 | Drnevich et al. | 62/24 |
| 5,265,429 | 11/1993 | Dray | 62/41 |

OTHER PUBLICATIONS

Springmann H., The Production Of High Pressure Oxygen, Linde Reports On Science And Technology, 1980.

*Primary Examiner*—Ronald C. Capossela
*Attorney, Agent, or Firm*—Stanley Ktorides

[57] ABSTRACT

A cryogenic air separation system wherein liquid oxygen is vaporized against condensing feed air and against condensing nitrogen which is taken from a higher pressure column and returned to the top of the higher pressure column, thus supplying added reflux for the air separation and enabling column system operation with improved flexibility and reduced energy usage.

7 Claims, 1 Drawing Sheet

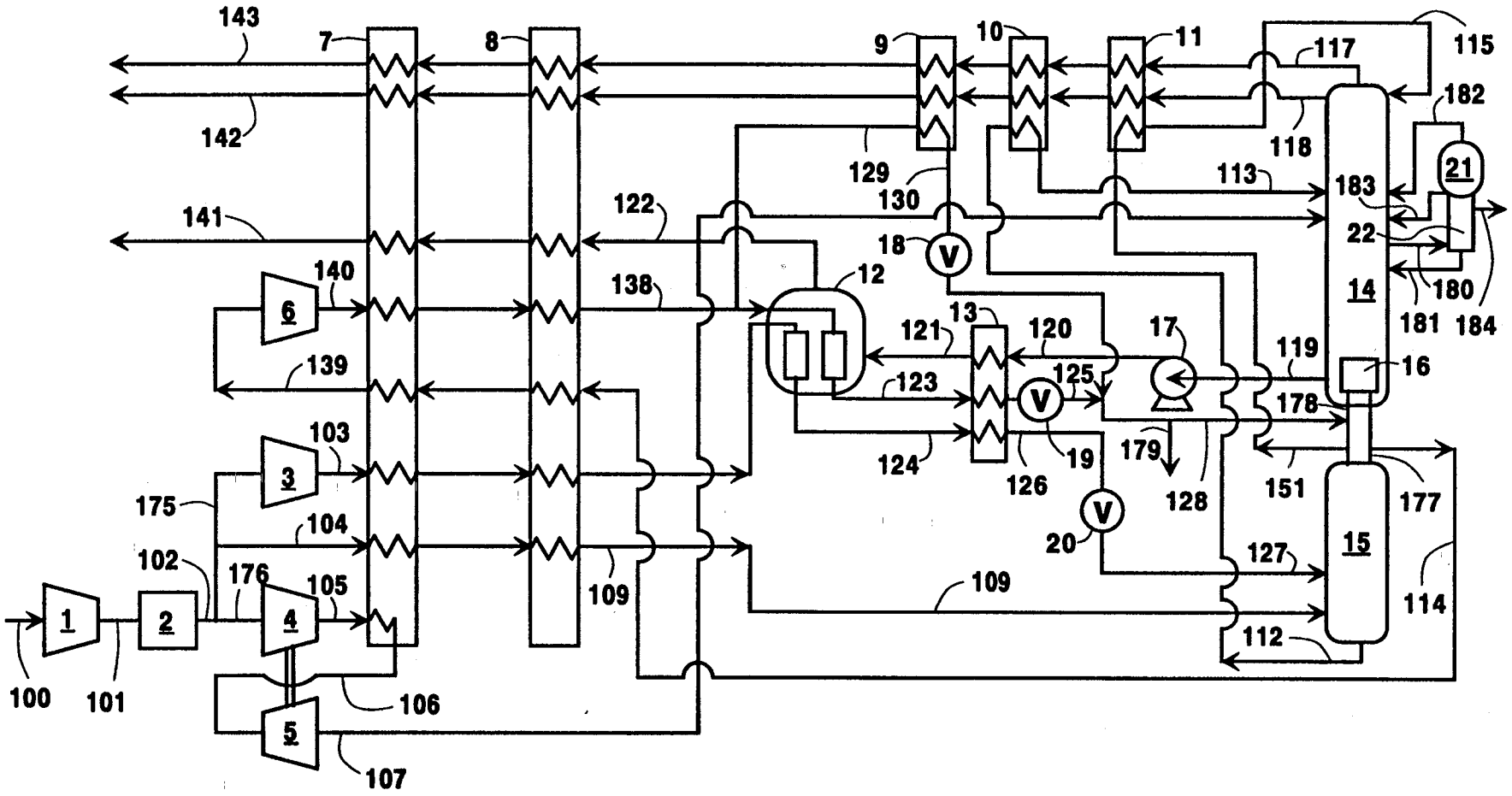
115
182
21
184
180
181
16
177
114
183
22
14
15
117
118
119
178
151
127
112
113
128
11
17
179
20
125
19
120
126
10
13
109
9
130
18
121
123
124
129
12
122
138
109
8
106
107
7
140
139
103
104
105
6
3
4
5
143
142
141
176
175
102
2
101
1
100

CRYOGENIC RECTIFICATION SYSTEM WITH HYBRID PRODUCT BOILER

TECHNICAL FIELD

This invention relates generally to the cryogenic rectification of mixtures comprising oxygen and nitrogen, e.g. air, and is particularly useful for carrying out such cryogenic rectification to produce high pressure product gas.

BACKGROUND ART

The demand for high pressure oxygen gas is increasing due to the greater use of high pressure oxygen in partial oxidation processes such as coal gasification for power generation, hydrogen production, and steelmaking. Often nitrogen is also employed in these processes.

Oxygen gas is produced commercially in large quantities generally by the cryogenic rectification of air. One way of producing the oxygen gas at high pressure is to compress the product oxygen gas from the cryogenic rectification plant. This, however, is costly both in terms of the capital costs for the product oxygen compressor and also in terms of the operating costs to power the product oxygen compressor. Another way of producing high pressure oxygen gas is to operate the cryogenic rectification plant at a higher pressure thus producing the oxygen at a higher initial pressure and reducing or eliminating downstream compression requirements. Unfortunately, operating the cryogenic rectification plant at a higher pressure reduces the efficiency of the production process because component separation depends on the relative volatilities of the components which decrease with increasing pressure. This is particularly the case when high pressure nitrogen product is also desired from the cryogenic rectification plant because the removal of nitrogen from the high pressure distillation column as product reduces the amount of reflux which may be employed thus reducing oxygen recovery.

In response to this problem there have been developed air separation processes wherein liquid oxygen is pressurized, such as by pumping or by hydrostatic means, and vaporized against an air stream which is either partially or totally condensed. This markedly reduces the compression costs for the elevated pressure oxygen gas product.

One problem with such systems is that the condensed air enters the high pressure column of the air separation plant near the bottom of the column. The air undergoes practically no distillation compared to air entering as a vapor at the bottom of the high pressure column. As a result, nitrogen, which is usually available as liquid nitrogen reflux for operation of the high pressure column and the low pressure column when all air enters the high pressure column as a vapor, is not separated from the liquid air. Since the reflux ratio of the high pressure column is fixed by the purity of reflux withdrawn from the top of the column and the number of equilibrium stages present in the column, there is produced less reflux for operation of the upper column resulting in the loss of product.

Nitrogen from the column system may be used in place of feed air to vaporize the liquid oxygen. However such an arrangement often results in the generation of more reflux than needed for the column system thus wasting power. Moreover, if the nitrogen is taken from the lower pressure column, significant power and capital costs are incurred in order to get the nitrogen to the requisite pressure for the product vaporization.

Accordingly, it is an object of this invention to provide a cryogenic rectification system which can produce product gas with improved efficiency over results attainable with conventional systems, especially at elevated product pressure.

It is another object of this invention to provide a cryogenic rectification system which can produce gas with improved efficiency wherein the amount of reflux generated may be adjusted to optimize the system performance.

SUMMARY OF THE INVENTION

The above and other objects which will become apparent to one skilled in the art upon a reading of this disclosure are attained by the present invention, one aspect of which is:

A method for producing oxygen gas by the cryogenic rectification of feed air using a column system comprising a first column and a second column, said method comprising:

(A) transition cooling feed air and passing resulting feed air into the first column operating at a pressure within the range of from 60 to 450 psia;

(B) separating feed air in the first column by cryogenic rectification into nitrogen-enriched vapor and oxygen-enriched liquid;

(C) passing oxygen-enriched liquid into the second column operating at a pressure less than that of the first column;

(D) transition-cooling nitrogen-enriched vapor and passing at least some of the resulting nitrogen-enriched fluid into the top of the first column;

(E) separating the fluids passed into the second column by cryogenic rectification into nitrogen-rich vapor and oxygen-rich liquid;

(F) increasing the pressure of the oxygen-rich liquid and thereafter transition-warming pressurized oxygen-rich liquid by indirect heat exchange with feed air and with nitrogen-enriched vapor to carry out the transition-cooling of steps (A) and (D) to produce oxygen gas; and (G) recovering oxygen gas as product.

Another aspect of the invention is:

Apparatus for the separation of feed air by cryogenic rectification comprising:

(A) a column system comprising a first column and a second column;

(B) a product boiler, means for passing feed air to the product boiler and from the product boiler into the first column;

(C) means for passing fluid from the first column to the product boiler and from the product boiler into the top of the first column;

(D) means for withdrawing fluid from the second column and means for increasing the pressure of the withdrawn fluid;

(E) means for passing said pressurized fluid to the product boiler; and (F) means for recovering product gas from the product boiler.

As used herein, the term "feed air" means a mixture comprising primarily nitrogen and oxygen such as air.

As used herein, the term "compressor" means a device for increasing the pressure of a gas.

As used herein, the term "expander" means a device used for extracting work out of a compressed gas by decreasing its pressure.

As used herein, the term "column" means a distillation or fractionation column or zone, i.e. a contacting column or zone wherein liquid and vapor phases are countercurrently contacted to effect separation of a fluid mixture, as for example, by contacting the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed and which may include a heat exchanger or a top condenser in its upper portion.

As used herein, the term "liquid oxygen" means a liquid having an oxygen concentration of at least 90 mole percent.

As used herein the term "liquid nitrogen" means a liquid having a nitrogen concentration of at least 99 mole percent.

As used herein, the term "transition-warming" means either the warming of a fluid which results in its vaporization from the liquid state to the vapor state, or the warming of a fluid at a pressure which is above its critical pressure.

As used herein, the term "transition-cooling" means either the cooling of a fluid which results in its condensation from the vapor state to the liquid state, or the cooling of a fluid at a pressure which is above its critical pressure.

As used herein the term "column system" means a facility wherein feed air is separated by cryogenic rectification, comprising at least one column and attendant interconnecting equipment such as pumps, piping, valves and heat exchangers.

As used herein the term "subcooled" means cooled below the vapor liquid equilibrium temperature.

As used herein, the terms "upper portion" and "lower portion" mean those sections of a column respectively above and below the midpoint of the column.

BRIEF DESCRIPTION OF THE DRAWING

The sole FIGURE is a schematic representation of one particularly preferred embodiment of the cryogenic rectification system of the invention wherein the feed air, the nitrogen-enriched vapor and the oxygen-rich liquid are each increased in pressure prior to their heat exchange in the product boiler.

DETAILED DESCRIPTION

The invention enables one to produce oxygen gas at elevated pressure while avoiding or reducing the degree of product gas compression and while providing the capability for adjusting the production of nitrogen reflux so as to improve the separation performance of the system.

The invention will be described in detail with reference to the Drawing. Referring now to the FIGURE, feed air 100 is compressed by passage through main air compressor 1 to a pressure within the range of from 60 to 450 pounds per square inch absolute (psia), preferably within the range of from 60 to 100 psia. Compressed feed air 101 is then passed through prepurification system 2 for the removal of high boiling impurities such as water vapor, carbon dioxide and hydrocarbons to produce cleaned feed air 102. A portion 175 of the feed air is compressed by booster feed air compressor 3 to a pressure within the range of from 100 to 2000 psia, preferably within the range of from 120 to 180 psia, and the resulting compressed stream 103 is then cooled in the primary heat exchanger warm and cold zones 7 and 8 respectively. Generally stream 103 will comprise from about 5 to 30 percent of the total feed air 100 which is ultimately provided into the column system.

Feed air stream 103 is then passed into product boiler 12 wherein it is transition-cooled by indirect heat exchange with transition-warming liquid oxygen as will be more fully discussed below. Resulting condensed feed air stream 124 is then subcooled by passage through subcooler 13 and subcooled stream 126 is throttled through valve 20 and passed as stream 127 into the lower portion of first column 15. The use of subcooler unit 13 is optional in the practice of this invention. Column 15 is the higher pressure column of a double column system and is operating at a pressure within the range of from 60 to 450 psia, preferably within the range of from 60 to 100 psia. 10 Another portion 176 of the feed air is compressed by booster compressor 4 and resulting compressed stream 105 is cooled in warm leg 7 of the primary heat exchanger. Resulting feed air stream 106 is expanded by passage through expander 5 and resulting expanded stream 107 is passed into second column 14. Column 14 is the lower pressure column of the double column system and is operating at a pressure less than that of higher pressure column 15 and generally within the range of from 12 to 125 psia. Preferably, as illustrated in the FIGURE, expander 5 is directly connected or coupled to booster compressor 4 so that the energy of the expanding feed air passing through expander 5 serves to directly drive compressor 4.

A third portion 104 of the feed air is cooled by passage through warm and cold legs 7 and 8 of the primary heat exchanger and resulting stream 109 is passed into first column 15. Within first column 15 the feed air is separated by cryogenic rectification into nitrogen-enriched vapor and oxygen-enriched liquid. Oxygen-enriched liquid is withdrawn from the lower portion of first column 15 as stream 112, subcooled in heat exchanger 10 and passed as stream 113 into second column 14. Nitrogen-enriched vapor is passed as stream 177 into main condenser 16 wherein it is condensed by indirect heat exchange with boiling column 14 bottom liquid. Resulting condensed nitrogen-enriched liquid 178 is then returned to first column 15 as reflux. A portion 151 of the nitrogen-enriched liquid is subcooled by passage through heat exchanger 11 and resulting subcooled stream 115 is passed into the upper portion of second column 14 as reflux.

A portion 114 of the nitrogen-enriched vapor is taken from the upper portion of first column 15 and warmed to about ambient temperature by passage through heat exchangers 8 and 7. Resulting nitrogen-enriched vapor stream 139 is compressed, generally to a pressure within the range of from 100 to 2000 psia, by passage through compressor 6 and the resulting pressurized stream 140 cooled by passage through heat exchangers 7 and 8 and then passed as stream 138 into product boiler 12. Within product boiler 12 the nitrogen-enriched vapor is transition-cooled by indirect heat exchange with transition-warming liquid oxygen. The resulting nitrogen-enriched liquid 123 is optionally subcooled by passage through heat exchanger 13 and subcooled stream 125 is throttled through valve 19 and passed as stream 128 into the top of first column 15 as reflux. By "top of the first column" it is meant at a point at or above the point wherein the condensed stream 178 from main condenser 16 is passed into the first column. In the embodiment illustrated in the FIGURE, stream 128 communicates with stream 178 and thus forms the reflux liquid which is passed into first column 15 and second column 14. By controlling the amount of nitrogen-enriched vapor passed to the product boiler one can control the amount of reflux liquid generated and thus optimize the operational performance of the rectification system.

If desired, a portion 129 of the nitrogen-enriched vapor may be taken from stream 138 upstream of the product boiler and condensed by indirect heat exchange with return streams in heat exchanger 9. Resulting stream 130 is then passed through valve 18 and passed into the column system such as by passage into stream 128. If desired, a stream 179 may be taken from stream 128 and recovered as product liquid nitrogen.

Within second column 14 the fluids passed into the column are separated by cryogenic rectification into nitrogen-rich vapor and oxygen-rich liquid. Nitrogen-rich vapor is withdrawn from second column 14 as stream 117, warmed by indirect heat exchange through heat exchangers 11, 10, 9, 8 and 7 and passed out of the system as stream 143 which may be recovered, in whole or in part, as product nitrogen gas having a purity of at least 99 mole percent. For control purposes a waste stream 118 is withdrawn from column 14 below the introduction point of reflux stream 115, passed through heat exchangers 11, 10, 9, 8 and 7, and removed from the system in stream 142.

Oxygen-rich liquid, i.e., liquid oxygen, is withdrawn from the lower portion of second column 14 as stream 19. Preferably stream 119 is increased in pressure to a pressure within the range of from 20 to 1000 psia, such as by passage through liquid pump 17. Pressurized oxygen-rich liquid stream 120 is then warmed to about its saturation temperature by passage through heat exchanger 13 and resulting stream 121 is passed into product boiler 12. For lower pressure oxygen production, heat exchanger 13 is less important from an efficiency standpoint and may be eliminated. Within product boiler 12 the oxygen-rich liquid is transition-warmed by indirect heat exchange with feed air and with nitrogen-enriched vapor to effect the aforesaid transition-cooling of these two fluids. The vaporization within product boiler 12 results in the production of oxygen gas which is withdrawn from product boiler 12 as stream 122, warmed by passage through heat exchangers 7 and 8 to, inter alia, cool the incoming feed air, and recovered in whole or in part in stream 141 as oxygen gas product having an oxygen concentration of at least 90 mole percent, and at a pressure of up to 1000 psia.

The invention may be practiced with a column system which includes an argon column. Such a system is illustrated in simplified form in the FIGURE. When an argon column is employed a stream 180 comprising primarily oxygen and argon is passed from second column 14 and fed into argon column 22 which includes argon column top condenser 21. Within argon column 22 the feed is separated by cryogenic rectification into argon-richer vapor and oxygen-richer liquid. The oxygen-richer liquid is returned to second column 14 as stream 181. When the argon column is used, oxygen-enriched liquid stream 113 is not passed directly into second column 14 as shown in the FIGURE, but rather is passed into argon column top condenser 21 wherein it is partially vaporized and then passed into column 14 as vapor and liquid streams 182 and 183 respectively. The oxygen-enriched liquid is partially vaporized in top condenser 21 by indirect heat exchange with argon-richer vapor which is condensed and employed in argon column 22 as reflux. Argon-richer fluid, in either vapor or liquid form, is recovered from column 22 in stream 184 as product crude argon having an argon concentration of at least 95 mole percent.

Now, by the use of the hybrid product boiler arrangement of this invention wherein oxygen-rich liquid is vaporized against both transition-cooling feed air and transition-cooling nitrogen-enriched vapor taken from the higher pressure column, one can operate a cryogenic rectification plant with improved recovery 10 efficiency over conventional plants which vaporize liquid oxygen against one or more process streams. In particular the invention is advantageous over systems which employ feed air and nitrogen from the lower pressure column to vaporize or transition-warm the oxygen because taking the nitrogen from the lower pressure column is equivalent to operating a heat pump between the product boiler temperature and the top of the lower pressure column which is an excessive temperature range. In contrast, in the practice of this invention wherein nitrogen is taken from the higher temperature column and the transition-cooled nitrogen passed into the top of the higher pressure column, sufficient reflux for both columns is generated while achieving this advantageous result with reduced power.

Although the invention has been described in detail with reference to a particularly preferred embodiment, those skilled in the art will recognize that there are other embodiments of the invention within the spirit and the scope of the claims. For example, heat exchangers 9, 10 and 11 may be combined into a single heat exchanger and heat exchangers 7 and 8 may also be combined into a single unit. To simplify manifolding of the primary heat exchanger, some of the streams may be segregated into separate cores. Also, compressors 3 and 6 could be integrated into a single machine.

It is claimed:

1. A method for producing oxygen gas by the cryogenic rectification of feed air using a column system comprising a first column and a second column, said method comprising:

(A) transition-cooling feed air and passing resulting feed air into the first column operating at a pressure within the range of from 60 to 450 psia;

(B) separating feed air in the first column by cryogenic rectification into nitrogen-enriched vapor and oxygen-enriched liquid;

(C) passing oxygen-enriched liquid into the second column operating at a pressure less than that of the first column.

(D) transition-cooling nitrogen-enriched vapor and passing at least some of the resulting nitrogen-enriched fluid into the top of the first column;

(E) separating the fluids passed into the second column by cryogenic rectification into nitrogen-rich vapor and oxygen-rich liquid;

(F) increasing the pressure of the oxygen-rich liquid and thereafter transition-warming pressurized oxygen-rich liquid by indirect heat exchange with feed air and with nitrogen-enriched vapor to carry out the transition-cooling of steps (A) and (D) to produce oxygen gas; and (G) recovering oxygen gas as product.

2. The method of claim 1 wherein the feed air is increased in pressure prior to the transition-cooling of step (A).

3. The method of claim 1 wherein the nitrogen-enriched vapor is increased in pressure prior to the transition-cooling of step (D).

4. Apparatus for the separation of feed air by cryogenic rectification comprising:

(A) a column system comprising a first column and a second column;

(B) a product boiler, means for passing feed air to the product boiler and from the product boiler into the first column;

(C) means for passing fluid from the first column to the product boiler and from the product boiler into the top of the first column;

(D) means for withdrawing fluid from the second column and means for increasing the pressure of the withdrawn fluid;

(E) means for passing said pressurized fluid from the second to the product boiler; and (F) means for recovering product gas from the product boiler.

5. The apparatus of claim 4 wherein the means for passing feed air to the product boiler includes a compressor.

6. The apparatus of claim 4 wherein the means for passing fluid from the first column to the product boiler includes a compressor.

7. The apparatus of claim 4 wherein the pressure increasing means is a liquid pump.

* * * * *

UNITED STATES PATENT AND TRADEMARK OFFICE

CERTIFICATE OF CORRECTION

PATENT NO. : 5,386,692
DATED : February 7, 1995
INVENTOR(S) : C. S. Laforce

It is certified that error appears in the above-identified patent and that said Letters Patent is hereby corrected as shown below:

In column 6, line 5 delete "19" and insert therefor - - 119 - -.

In column 6, line 53 delete "10".

In claim 4, lines 14 and 15 delete "from the second".

Signed and Sealed this

Second Day of June, 1998

*Attest:*

Bruce Lehman

BRUCE LEHMAN

*Attesting Officer*

*Commissioner of Patents and Trademarks*